US012638213B2

(12) United States Patent
Ott

(10) Patent No.: US 12,638,213 B2
(45) Date of Patent: May 26, 2026

(54) HINGE WITH MOTION DAMPING INTERFACE

(71) Applicant: PRE-VENT SOLUTIONS LLC, Taylors, SC (US)

(72) Inventor: Keith Ott, Taylors, SC (US)

(73) Assignee: PRE-VENT SOLUTIONS LLC, Taylors, SC (US)

( * ) Notice: Subject to any disclaimer, the term of this patent is extended or adjusted under 35 U.S.C. 154(b) by 501 days.

(21) Appl. No.: 18/298,417

(22) Filed: Apr. 11, 2023

(65) Prior Publication Data

US 2023/0349587 A1 Nov. 2, 2023

Related U.S. Application Data

(60) Provisional application No. 63/349,684, filed on Jun. 7, 2022, provisional application No. 63/336,534, filed on Apr. 29, 2022.

(51) Int. Cl.
*F24F 13/14* (2006.01)
*F24F 7/00* (2021.01)

(52) U.S. Cl.
CPC .. *F24F 13/1486* (2013.01); *F24F 2007/0025* (2021.01)

(58) Field of Classification Search
CPC ..... F24F 13/1486; F24F 2007/0025
USPC ..... 454/358
See application file for complete search history.

(56) References Cited

U.S. PATENT DOCUMENTS

| | | | | |
|---|---|---|---|---|
| 3,145,643 | A | 8/1964 | Strouth | |
| 3,285,155 | A | 11/1966 | Maltenfort | |
| 4,047,475 | A | 9/1977 | Cox | |
| 5,344,363 | A | 9/1994 | Pollock | |
| 6,772,538 | B2 | 8/2004 | Vagedes | |
| 7,988,544 | B2 | 8/2011 | Vanden Bosch et al. | |
| 9,850,620 | B2 | 12/2017 | Ott | |
| 2002/0078529 | A1* | 6/2002 | Schwarz | E05F 3/20 16/387 |
| 2008/0176502 | A1* | 7/2008 | Hashimoto | F24F 13/1486 454/145 |
| 2009/0025181 | A1* | 1/2009 | Burger | E05F 3/20 16/286 |
| 2011/0097990 | A1 | 4/2011 | Charron | |
| 2015/0354127 | A1* | 12/2015 | Ott | D06F 58/20 34/235 |

* cited by examiner

*Primary Examiner* — Steven B Mcallister
*Assistant Examiner* — Charles R Brawner
(74) *Attorney, Agent, or Firm* — Price Heneveld LLP

(57) ABSTRACT

A vent enclosure includes a mount that has a receiver that includes an enclosed volume. The mount is configured to be positioned proximate a vent aperture. A viscous material is disposed within the enclosed volume. A panel is rotationally coupled to the receiver. The panel is configured to be operable between a blocking position and an outflow position. The panel is configured to be moved to the outflow position in response to a flow of process air moving through the vent aperture. The panel returns to the blocking position under a force of gravity. The vent enclosure further includes a hinge that is attached to the panel and the receiver. The hinge engages the viscous material, and rotation of the panel and the hinge rotationally operates the hinge relative to the viscous material. The viscous material slows the rotational operation of the hinge.

20 Claims, 4 Drawing Sheets

HINGE WITH MOTION DAMPING INTERFACE

CROSS-REFERENCE TO RELATED APPLICATIONS

This application claims priority to and the benefit under 35 U.S.C. § 119(e) of U.S. Provisional Patent Application No. 63/336,534, filed on Apr. 29, 2022, entitled "VENT ENCLOSURE," and U.S. Provisional Patent Application No. 63/349,684, filed Jun. 7, 2022, entitled "VENT ENCLOSURE," the entire disclosures of which are hereby incorporated herein by reference.

FIELD OF THE DISCLOSURE

The present device generally relates to hinge-type mechanisms that can be used within various vent-related applications, and more specifically, a hinge with a motion damping interface that is disposed within an enclosure, and which operates to dampen movement of a hinge and a panel attached to the hinge during operation of the panel between various positions.

BACKGROUND OF THE DISCLOSURE

Vent mechanisms and other hinge-related applications often include a panel that is moved between a plurality of rotational positions. As these panels rotate, the panel can impact against the substrate or portion of a device near the panel, thereby resulting in noisy impacts that can, in certain conditions, cause damage to particular devices around the hinge mechanism.

SUMMARY OF THE DISCLOSURE

In at least one aspect of the present disclosure, a vent enclosure includes a mount that has a receiver that includes an enclosed volume. The mount is configured to be positioned proximate a vent aperture. A viscous material is disposed within the enclosed volume. A panel is rotationally coupled to the receiver. The panel is configured to be operable between a blocking position and an outflow position. The panel is configured to be moved to the outflow position in response to a flow of process air moving through the vent aperture. The panel returns to the blocking position under a force of gravity. The vent enclosure further includes a hinge that is attached to the panel and the receiver. The hinge engages the viscous material, and rotation of the panel and the hinge rotationally operates the hinge relative to the viscous material. The viscous material slows the rotational operation of the hinge.

According to another aspect of the present disclosure, a damping hinge for a closable air vent includes a panel that is operable between a blocking position that closes an airflow path in an absence of process air and an outflow position. Motion of the process air through the airflow path biases the panel away from the blocking position. The hinge member further includes a receiver that is secured to a substrate, and a hinge that is attached to the panel and the receiver and defines a rotational axis about which the panel rotates between the blocking position and the outflow position. The hinge is disposed within the receiver and rotationally operates through a viscous material disposed within the receiver. Rotation of the panel and the hinge rotationally operates the hinge relative to the viscous material. The viscous material dampens the rotational operation of the hinge.

According to yet another aspect of the present disclosure, a damping hinge for an operable air vent includes a panel that is operable between an outflow position characterized by a flow of process air biasing the panel away from a blocking position. The panel conceals a vent aperture. The hinge member further includes a receiver that is secured to a structural substrate, and a hinge that is fixedly attached to the panel and operably coupled to the receiver. The hinge defines a rotational axis about which the panel rotates between the blocking position and the outflow position. The hinge extends through the receiver and rotationally operates through a viscous material disposed within the receiver. Rotation of the panel by the flow of process air rotationally operates the hinge relative to the viscous material. The viscous material dampens the rotational operation of the hinge in a first rotational direction about the rotational axis and in a second rotational direction about the rotational axis. The second rotational direction being in opposition to the first rotational direction.

These and other features, advantages, and objects of the present disclosure will be further understood and appreciated by those skilled in the art by reference to the following specification, claims, and appended drawings.

The components in the figures are not necessarily to scale, emphasis instead being placed upon illustrating the principles described herein.

DETAILED DESCRIPTION

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
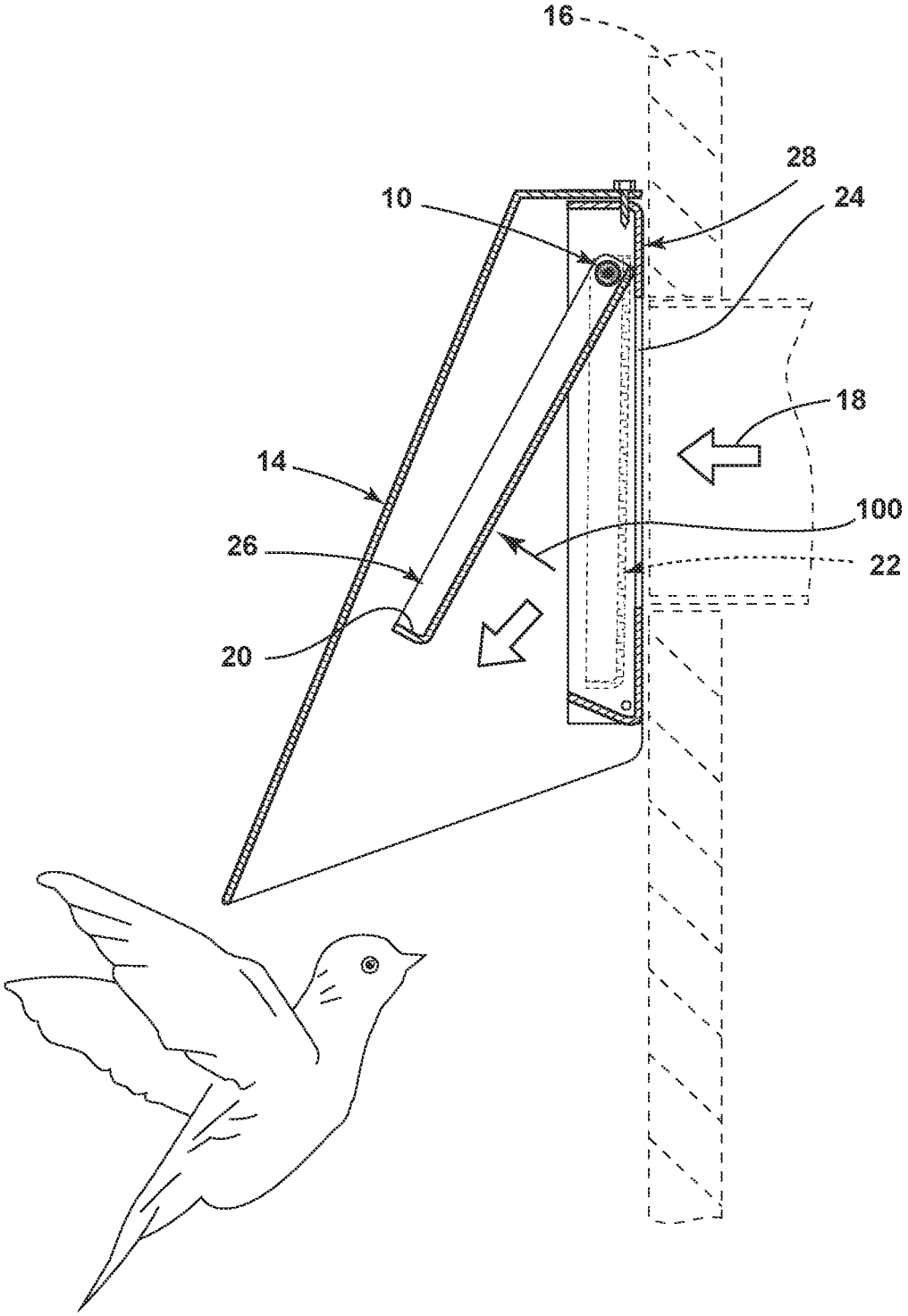
FIG. 1 is a schematic cross-sectional of a vent that incorporates an aspect of the damping hinge having the motion-damping interface.
Figure 2:
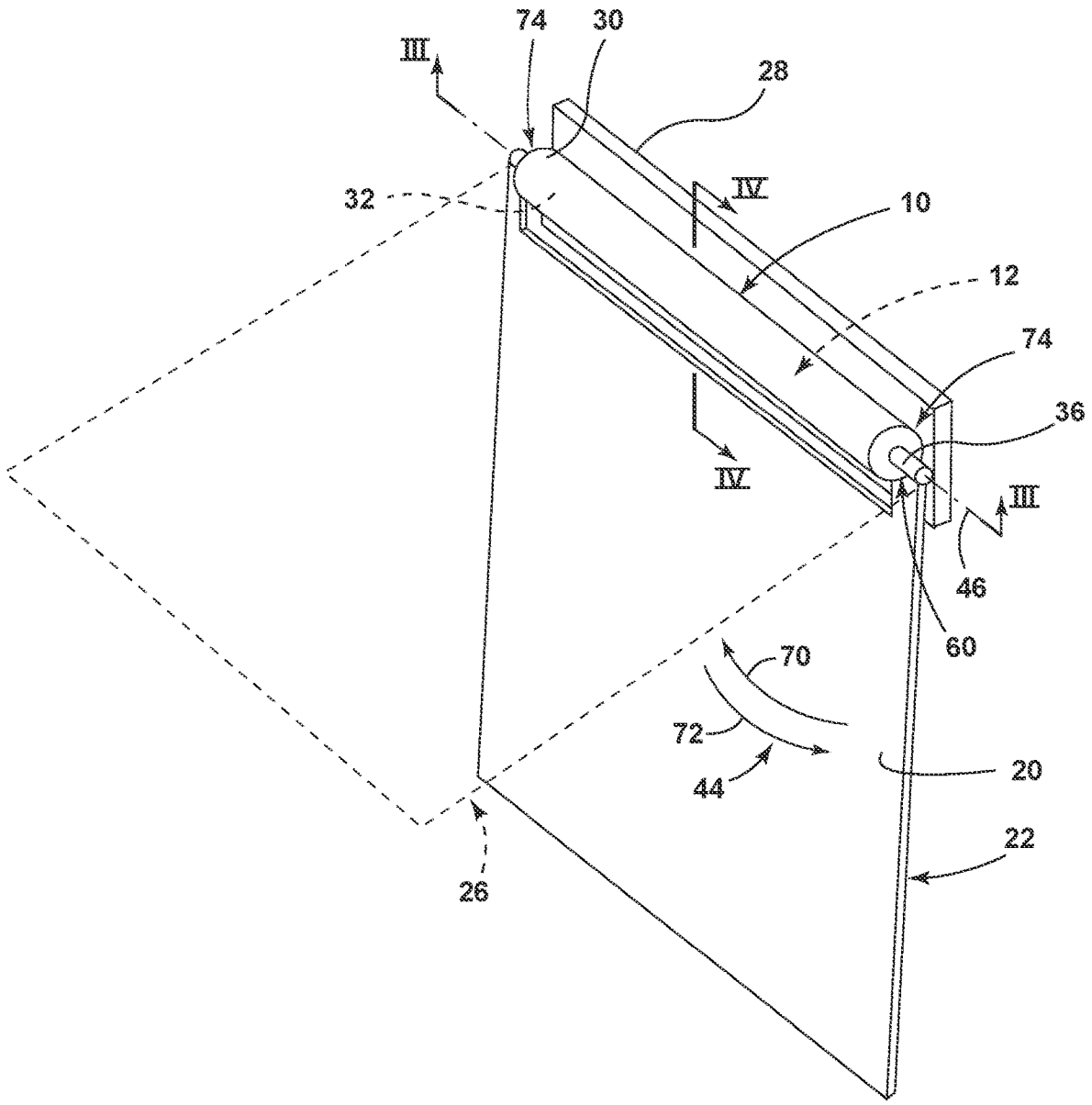
FIG. 2 is a schematic perspective view of the damping hinge and the attached panel showing motion of the panel between a plurality of rotational positions.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims.

Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a hinge mechanism that includes a motion-damping interface, where the motion-damping interface operates to slow the motion of a panel about a rotational axis in both directions of rotational movement. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-4, reference numeral 10 generally designates a damping hinge that includes a motion-damping interface 12. This damping hinge 10 can be utilized within any one of various rotational mechanisms. According to various aspects of the device, as exemplified in FIG. 1, the damping hinge 10 can be utilized in a vent enclosure 14 that can be attached to a structure 16 for allowing passage of process air 18 through the structure 16, while also preventing ingress of birds, animals, and other creatures into the structure 16. The vent enclosure 14 can also be used to prevent ingress of particles from outside the structure 16. These vent enclosures 14 are typically attached to a dryer vent, or other similar blower vent, that provides for a movement of process air 18 from within the structure 16, to an exterior of the structure 16. As discussed herein, these vent enclosures 14 can also be utilized for various closure mechanisms that can be used for selectively opening and closing certain access points within and around a particular structure 16. Such access points can be integrated within an HVAC system, a plumbing system, or other similar plumbing and/or mechanical systems of a structure 16. Such access points can include various vents, apertures, and other similar openings within the structure 16 that allows for the movement of material, typically air or vented gases, to be removed from the structure 16.

Referring again to FIGS. 1-4, it is contemplated that the vent enclosure 14 can include a panel 20 that is rotationally operable between a blocking position 22 that covers a vent aperture 24 and an outflow position 26 that is distal from the vent aperture 24 and allows for movement of process air 18 through the vent aperture 24 and into the outer atmosphere surrounding the structure 16. Holding the panel 20 is the damping hinge 10 attached to a mount 28. The damping hinge 10 includes a receiver 30 having an enclosed volume 32. The mount 28 is configured to be positioned proximate the vent aperture 24. This configuration and positioning of the mount 28 allows the panel 20 to cover or conceal the vent aperture 24 in the blocking position 22. The receiver 30 for the damping hinge 10 includes the enclosed volume 32 where a viscous material 34 is disposed within this enclosed volume 32. The panel 20 is rotationally coupled to the receiver 30. The panel 20 is configured to be operable between the blocking position 22 and the outflow position 26, wherein the panel 20 is configured to be moved to the outflow position 26 in response to a flow of process air 18 moving through the vent aperture 24. The panel 20 returns to the blocking position 22 under the force of gravity.

Referring again to FIGS. 1-4, a hinge member 36 is attached to the panel 20 and is engaged with the receiver 30. The hinge member 36 engages the viscous material 34 contained within the enclosed volume 32 of the receiver 30. Rotation of the panel 20 rotationally operates the hinge member 36 relative to the viscous material 34. In this manner, the viscous material 34 interacts with the outer surface 38 of the hinge member 36 and the inner surface 40 of the receiver 30, thereby creating a laminar flow 42 of the viscous material 34 as the hinge member 36 rotates through the viscous material 34. Because the viscous material 34 has a sufficient viscosity, as described herein, rotational movement 44 of the hinge member 36 relative to the receiver 30 is slowed. In turn, movement of the panel 20, which is fixedly attached to the hinge member 36, also slows as the panel 20 moves between the outflow position 26 and the blocking position 22. This configuration of the hinge member 36, the receiver 30, and the viscous material 34 slows movement of the panel 20 toward the blocking position 22 such that the panel 20 softly engages the structure 16 and prevents unwanted banging and/or noise during operation of the panel 20. Additionally, the air pressure generated by the process air 18 that builds behind the panel 20 is sufficient to push or otherwise bias the panel 20 from the blocking position 22 to the outflow position 26. Again, the viscosity of the viscous material 34 slows the rotational movement 44 of the panel 20 away from the blocking position 22 and about the rotational axis 46 due to the laminar flow 42 of the viscous material 34. The laminar flow 42 of the viscous material 34 minimizes or eliminates turbulence that may be formed in other less-viscous materials. Accordingly, layers of the viscous material 34, during rotational movement 44 of the hinge member 36, move relative to one another, but do not mix or do not substantially mix. Through this configuration of the viscous material 34, the generation of turbulence or mixing within the layers of the viscous material 34 is kept to a minimum or is eliminated. This lack of mixing or interaction between the layers of the viscous material 34 operates to slow or dampen the rotational movement 44 of the hinge member 36 relative to the receiver 30.

Figure 3:
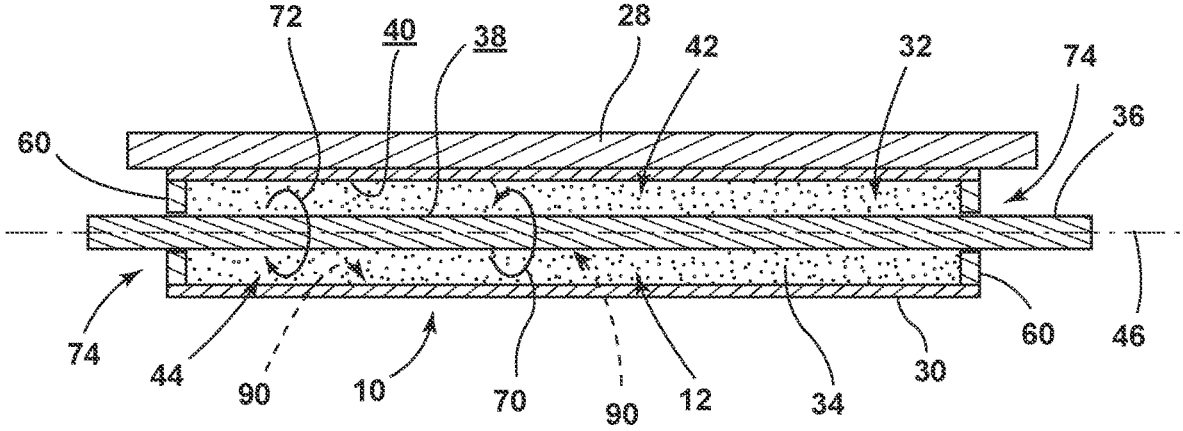
FIG. 3 is a cross-sectional view of the damping hinge of FIG. 2 taken along the line III-Ill.
Figure 4:
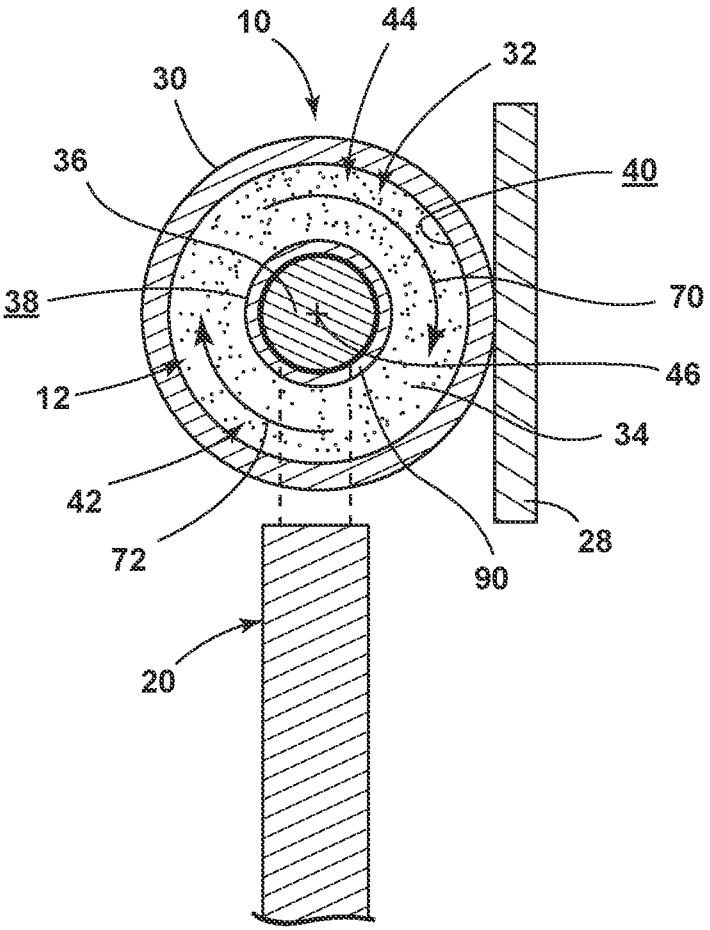
FIG. 4 is a cross-sectional view of the damping hinge of FIG. 2 taken along the line IV-IV.

According to various aspects of the device, as exemplified in FIGS. 3 and 4, the enclosed volume 32 of the receiver 30 can be in the form of a sealed volume with the viscous material 34 contained therein. The hinge member 36 can extend through a sealed engagement 60 with the receiver 30 such that the hinge member 36 rotates about the rotational axis 46 but is also sealed such that the viscous material 34 is contained within the enclosed volume 32 of the receiver 30.

Referring again to FIGS. 3 and 4, it is contemplated that the receiver 30 can be in the form of an enclosed tube or other similar extruded form that is fixedly attached to the mount 28. The hinge member 36, similarly, can be fixed in relation to the panel 20 such that the hinge member 36 moves with the panel 20 and the receiver 30 maintains a consistent position relative to the mount 28. The hinge member 36 can be a rod, tube, shaft, or other similar elongated shape. It is also contemplated that the hinge can extend only partially into the enclosed volume 32 of the receiver 30 to engage the viscous material 34.

According to various aspects of the device, it is contemplated that the viscous material 34 can be sufficiently consistent in terms of viscosity through a wide range of temperatures, humidities, barometric pressures, and other climatic and weather conditions that may be experienced by the vent enclosure 14.

According to various aspects of the device, the viscosity of the viscous material 34 can have any one of various Reynolds values that are below approximately 4000 or below approximately 2000. These values are useful at generating the laminar flow 42 as the hinge member 36 rotates through the viscous material 34 contained within the enclosed volume 32 of the receiver 30. Additionally, the material that forms the viscous material 34 can vary depending upon the design of the panel 20. Factors that can affect the design of the viscous material 34 can include, but are not limited to, the size of the panel 20, the material of the panel 20, the weight of the panel 20, the amount of process air 18 that is configured to move through the vent aperture 24, combinations thereof, and other similar factors.

Referring again to FIGS. 1-4, according to the various aspects of the device, a damping hinge 10 for a closable air vent or vent enclosure 14 can include a panel 20 that is operable between the blocking position 22 that closes the airflow path. This blocking position 22 is typically experienced in the absence of process air 18 moving through the airflow path. The panel 20 is also operable to the outflow position 26. The outflow position 26 is experienced when motion of process air 18 moving through the airflow path pushes or otherwise biases the panel 20 away from the blocking position 22 and into the outflow position 26. A receiver 30 of the damping hinge 10 is attached to a substrate, typically in the form of a portion of the structure 16, or a portion of the vent enclosure 14. The hinge member 36 is attached to the panel 20 and is coupled with the receiver 30. In this manner, the hinge member 36 defines a rotational axis 46 about which the panel 20 rotates between the blocking position 22 and the outflow position 26. The hinge member 36 is disposed within the receiver 30 and rotationally operates about the rotational axis 46 through a viscous material 34 that is disposed within the receiver 30. Rotational movement 44 of the panel 20 and the hinge member 36 operates the hinge member 36 relative to the viscous material 34. The viscous material 34 dampens the rotational movement 44 of the hinge member 36 in each of the first rotational direction 70 and the second rotational direction 72, that opposes the first rotational direction 70. Typically, the first rotational direction 70 and the second rotational direction 72 will be indicative of a clockwise and counter-clockwise rotation, respectively.

Referring again to FIGS. 1-4, the receiver 30 includes the interior enclosed volume 32 that contains the viscous material 34. This viscous material 34 is typically sealed within the receiver 30, with the hinge member 36 extending through the receiver 30, such that the hinge member 36 extends through the sealed engagement 60 with the receiver 30. In this manner, the viscous material 34 is contained within the receiver 30 and the hinge member 36 extends through the receiver 30 and through the viscous material 34. The sealed engagement 60 of the receiver 30 can be defined by gaskets, end caps, sealed grommets, seals, or other similar sealing mechanisms that can be positioned on opposing ends 74 of the receiver 30. It is also contemplated that various bearings, slidable interfaces, or other similar engagements can be formed between the hinge member 36 and the sealing engagement of the receiver 30 to allow for rotational movement 44 of the hinge member 36 and the panel 20 relative to the receiver 30 and the remainder of the vent enclosure 14.

Referring again to FIGS. 2-4, during the rotational movement 44 of the hinge member 36 between the blocking position 22 and the outflow position 26, the outer surface 38 of the hinge member 36 and the inner surface 40 of the receiver 30 generates the laminar flow 42 of the viscous material 34 within the receiver 30. This laminar flow 42 of the viscous material 34 during rotation of the hinge dampens the rotational movement 44 of the hinge member 36. In turn, the dampened rotational movement 44 of the hinge member 36 results in a dampened movement of the panel 20 about the rotational axis 46. This dampened rotational movement 44, as discussed herein, is dampened with respect to the first rotational direction 70 and the second rotational direction 72.

It is contemplated that this dampened rotational movement 44 is characterized by slowed rotation of the hinge member 36 and the panel 20 about the rotational axis 46. Accordingly, when the process air 18 moves through the airflow path, the force of the process air 18 will be sufficient to move the panel 20 and the hinge member 36 about the rotational axis 46. However, the laminar flow 42 of the viscous material 34 and the interaction of the viscous material 34 with the hinge member 36 and the receiver 30 will result in this rotational movement 44 of the panel 20 and the hinge member 36 being slowed. Similarly, when the movement of process air 18 stops, the weight of the panel 20, according to the force of gravity, will cause the panel 20 and the hinge member 36 to return to the blocking position 22. As with the rotational movement 44 of the panel 20 toward the outflow position 26, as the panel 20 returns to the blocking position 22, the viscous material 34 will cause a dampened rotational movement 44 of the panel 20 and the hinge member 36 toward the blocking position 22. Again, this movement will be a slowed rotational movement 44 that moves toward the blocking position 22. This slowed movement in the first rotational direction 70 and the second rotational direction 72 operates to prevent significant impact between the panel 20 and various structures 16 surrounding the panel 20 as the panel 20 moves between the blocking position 22 and the outflow position 26.

According to various aspects of the device, the viscous material 34 can be a silicone-type material. It is contemplated that this silicone-type material can include a viscosity of greater than approximately 1,000,000 centistokes. The unit of the centistoke is typically equal to approximately one millimeter squared per second ($mm^2/s$). This is a unit for kinematic velocity. The absolute or dynamic viscosity of a material is typically equal to the kinematic velocity, multiplied by the density of the fluid. According to the various aspects of the device, the viscosity of the viscous material 34 can also be from approximately 1,000,000 centistokes to approximately 1,500,000 centistokes. It is also contemplated that the viscous material 34 can have a viscosity from approximately 750,000 centistokes to approximately 1,500,000 centistokes. It is also contemplated that the viscous material 34 can have a viscosity from approximately 1,100,000 centistokes to approximately 1,300,000 centistokes. As the viscosity of the viscous material 34 increases, the Reynolds number, relating to the laminarity of the flow of the material decreases.

According to the various aspects of the device, it is contemplated that the laminar flow 42 of the viscous material 34 between the outer surface 38 of the hinge member 36 and the inner surface 40 of the receiver 30 can, in part, be generated through a textured component that interacts with the viscous material 34 to produce the laminar flow 42. It is contemplated that this textured component can be in the form of any one of various surface conditions that can include, but are not limited to, knurling, etching, and other forms of raised textured surfaces that are incorporated within the inner surface 40 of the receiver 30, the outer surface 38 of the hinge member 36, or both. It is also contemplated that the textured component can be formed through various protrusions that can extend from the inner surface 40 of the receiver 30 and/or the outer surface 38 of the hinge member 36 that is disposed within the receiver 30. These textured components 90 are configured to interact with the viscous material 34 to assist in producing the laminar flow 42. It is contemplated that the outer surface 38 of the hinge member 36 and the inner surface 40 of the receiver 30 can be a generally smooth surface such that the surface contact between the viscous material 34 and the receiver 30 and the hinge member 36 can produce the laminar flow 42 as the hinge member 36 rotates about the rotational axis 46.

Referring again to FIGS. 1-4, it is contemplated that the hinge member 36 for the operable air vent can include the panel 20 that is operable between the outflow position 26 characterized by a flow of process air 18 biasing the panel 20 away from a blocking position 22 that conceals a vent aperture 24. The receiver 30 is secured to a structural substrate. The hinge member 36 is fixedly attached to the panel 20 and is operably coupled to the receiver 30. The hinge member 36 defines the rotational axis 46 about which the panel 20 and the hinge member 36 rotate between the blocking position 22 and the outflow position 26. The hinge member 36 extends through the receiver 30 and rotationally operates through the viscous material 34 that is disposed within the receiver 30. Rotation of the panel 20, caused by the biasing force 100 of the process air 18 through the airflow path rotationally operates the hinge member 36 relative to the viscous material 34. The viscous material 34 operates to dampen the rotational movement 44 of the hinge member 36 in the first rotational direction 70 about the rotational axis 46 and in the second rotational direction 72 about the rotational axis 46. As described herein, the second rotational direction 72 is opposite to the first rotational direction 70.

According to the various aspects of the device, the viscous material 34 disposed within the damping hinge 10 operates to slow rotation of the panel 20 and the hinge member 36 about the rotational axis 46. This configuration prevents significant impacts between the panel 20 and the structures 16 surrounding the panel 20. These impacts typically cause unwanted noise and can cause damage to the panel 20 as well as various components within and surrounding the damping hinge 10. According to the various aspects of the device, the hinge member 36 and the receiver 30 can be made from any one of various materials. Such materials can include, but are not limited to, metal, plastic, composite, combinations thereof, and other similar materials that can contain the viscous material 34 and also provide for the rotational movement 44 of the hinge member 36 and the panel 20 about the rotational axis 46. The panel 20 is typically made from a metallic material such that the panel 20 has a substantial weight such that gravity can move the panel 20 from the outflow position 26 to the blocking position 22. It is also contemplated that the panel 20 can be made of a lighter material with certain weighted components that allow for the force of gravity to move the panel 20 from the outflow position 26 to the blocking position 22, as described herein. The use of the viscous material 34 within the damping hinge 10 allows for these materials to be utilized within the respective components without generating significant noise, clinging, and other similar impact-type conditions that can cause unwanted noise and damage to various components around the damping hinge 10.

It is contemplated that the damping hinge 10 described herein can be used as a general purpose hinge that can be utilized in a wide range of rotational applications. While a vent enclosure 14 is described herein, this is an exemplary application. It should be understood that the damping hinge 10 having the viscous material 34 can be used in other applications that can be unrelated to vents, HVAC systems, and plumbing systems. The damping hinge 10 can be utilized within any rotational interface where the rotational movement 44 of a component is intended to be dampened or slowed.

It will be understood by one having ordinary skill in the art that construction of the described disclosure and other components is not limited to any specific material. Other exemplary embodiments of the disclosure disclosed herein may be formed from a wide variety of materials, unless described otherwise herein.

What is claimed is:

1. A vent enclosure comprising:

a mount having a receiver that includes an enclosed volume, the mount configured to be positioned proximate a vent aperture;

a viscous material disposed within the enclosed volume;

a panel that is rotationally coupled to the receiver, wherein the panel is configured to be operable between a blocking position and an outflow position, wherein the panel is configured to be moved to the outflow position in response to a flow of process air moving through the vent aperture, and wherein the panel returns to the blocking position under a force of gravity; and a hinge that is attached to the panel and the receiver, wherein the hinge engages the viscous material, wherein rotation of the panel and the hinge rotationally operates the hinge relative to the viscous material, wherein the viscous material slows the rotational operation of the hinge, wherein the enclosed volume of the receiver is a sealed volume with the viscous material contained therein, wherein the hinge extends through a sealed engagement with the receiver, and wherein during rotation of the hinge, an outer surface of the hinge and an inner surface of the receiver generate a laminar flow of the viscous material within the receiver.

2. The vent enclosure of claim 1, wherein the laminar flow of the viscous material dampens rotation of the hinge and the panel in a first rotational direction and in a second rotational direction that opposes the first rotational direction.

3. The vent enclosure of claim 1, wherein the viscous material is silicone having a viscosity greater than approximately 1,000,000 centistokes (square millimeters per second).

4. The vent enclosure of claim 1, wherein the viscous material has a viscosity of from approximately 750,000 centistokes to approximately 1,500,000 centistokes.

5. The vent enclosure of claim 1, wherein the outer surface of the hinge and the inner surface of the receiver include a textured component that interacts with the viscous material to produce the laminar flow.

6. The vent enclosure of claim 5, wherein the textured component includes at least one of knurling, etching, and raised protrusions.

7. The damping vent hinge of claim 1, wherein the hinge extends through the receiver.

8. A damping vent hinge for a closable air vent, the damping vent hinge comprising:

a panel that is operable between a blocking position that closes an airflow path in an absence of process air and an outflow position, where motion of the process air through the airflow path biases the panel away from the blocking position;

a receiver that is secured to a substrate; and a hinge that is attached to the panel and the receiver and defines a rotational axis about which the panel rotates between the blocking position and the outflow position, wherein the hinge is disposed within the receiver and rotationally operates through a viscous material disposed within the receiver, wherein rotation of the panel and the hinge rotationally operates the hinge relative to the viscous material, wherein the viscous material dampens the rotational operation of the hinge, wherein the viscous material is sealed within the receiver and the hinge extends through a sealed engagement with the receiver, and wherein during rotation of the hinge, an outer surface of the hinge and an inner surface of the receiver generate a laminar flow of the viscous material within the receiver.

9. The damping vent hinge of claim 8, wherein the receiver includes a volume that contains the viscous material.

10. The damping vent hinge of claim 8, wherein the laminar flow of the viscous material dampens rotation of the hinge and the panel in a first rotational direction and in a second rotational direction that opposes the first rotational direction.

11. The damping vent hinge of claim 8, wherein the viscous material is silicone having a viscosity greater than approximately 1,000,000 centistokes (square millimeters per second).

12. The damping vent hinge of claim 11, wherein the viscous material has a viscosity of from approximately 1,000,000 centistokes to approximately 1,500,000 centistokes.

13. The damping vent hinge of claim 8, wherein the outer surface of the hinge and the inner surface of the receiver include a textured component that interacts with the viscous material to produce the laminar flow.

14. The damping vent hinge of claim 8, wherein the hinge extends through the receiver.

15. A damping vent hinge for an operable air vent, the damping vent hinge comprising:

a panel that is operable between an outflow position characterized by a flow of process air biasing the panel away from a blocking position, wherein the panel conceals a vent aperture;

a receiver that is secured to a structural substrate; and a hinge that is fixedly attached to the panel and operably coupled to the receiver, the hinge defining a rotational axis about which the panel rotates between the blocking position and the outflow position, wherein the hinge extends through the receiver and rotationally operates through a viscous material disposed within the receiver, wherein rotation of the panel by the flow of the process air rotationally operates the hinge relative to the viscous material, wherein the viscous material dampens the rotational operation of the hinge in a first rotational direction about the rotational axis and in a second rotational direction about the rotational axis, the second rotational direction being in opposition to the first rotational direction, wherein the receiver includes a sealed volume with the viscous material contained therein, wherein the hinge extends through a sealed engagement with the receiver, and wherein during rotation of the hinge, an outer surface of the hinge and an inner surface of the receiver generate a laminar flow of the viscous material within the receiver.

16. The damping vent hinge of claim 15, wherein the viscous material is silicone having a viscosity greater than approximately 1,000,000 centistokes (square millimeters per second).

17. The damping vent hinge of claim 16, wherein the viscous material has a viscosity of from approximately 1,000,000 centistokes to approximately 1,500,000 centistokes.

18. The damping vent hinge of claim 13, wherein the textured component includes at least one of knurling, etching, and raised protrusions.

19. The damping vent hinge of claim 15, wherein the outer surface of the hinge and the inner surface of the receiver include a textured component that interacts with the viscous material to produce the laminar flow.

20. The damping vent hinge of claim 19, wherein the textured component includes at least one of knurling, etching, and raised protrusions.

* * * * *